United States Patent [19]

Molins et al.

[11] 4,222,477

[45] Sep. 16, 1980

[54] RESERVOIR FOR CIGARETTES AND LIKE ARTICLES

[75] Inventors: Desmond W. Molins; Dennis Hinchcliffe, both of London, England

[73] Assignee: Molins Limited, England

[21] Appl. No.: 950,670

[22] Filed: Oct. 12, 1978

[30] Foreign Application Priority Data

Oct. 27, 1977 [GB] United Kingdom ..... 44671/77

[51] Int. Cl.[2] ..... B65G 43/08

[52] U.S. Cl. ..... 198/347; 198/572; 198/577; 198/579

[58] Field of Search ..... 198/347, 572, 573, 577, 198/579; 131/21 R, 21 A, 21 B

[56] References Cited

U.S. PATENT DOCUMENTS

| | | | |
|---|---|---|---|
| 3,305,128 | 2/1967 | Dearsley | 198/347 X |
| 3,355,004 | 11/1967 | Rupert | 198/572 |
| 3,923,146 | 12/1975 | Van Hall | 198/347 |
| 3,952,854 | 4/1976 | Selonke et al. | 198/347 |
| 4,147,247 | 4/1979 | Clarke | 198/347 |

FOREIGN PATENT DOCUMENTS

| | | | |
|---|---|---|---|
| 1168964 | 10/1967 | United Kingdom | 131/21 A |

*Primary Examiner*—James L. Rowland
*Attorney, Agent, or Firm*—Craig & Antonelli

[57] ABSTRACT

A reservoir system for cigarettes and other similar rod-shaped articles comprises a delivery conveyor arranged to convey the articles horizontally towards an inlet to the reservoir; a reservoir conveyor which lies below the delivery conveyor and is arranged to receive a stack of the articles delivered through the inlet and to run, when necessary, in a direction opposite to that of the delivery conveyor; a horizontally movable carriage carrying a movable end wall defining an end of the stack of articles on the reservoir conveyor adjacent to the inlet, and carrying also a sensor adjacent to the inlet which controls the direction (and possibly also the speed) of movement of the carriage; and an outlet for articles at the end of the reservoir conveyor towards which the latter moves.

8 Claims, 1 Drawing Figure

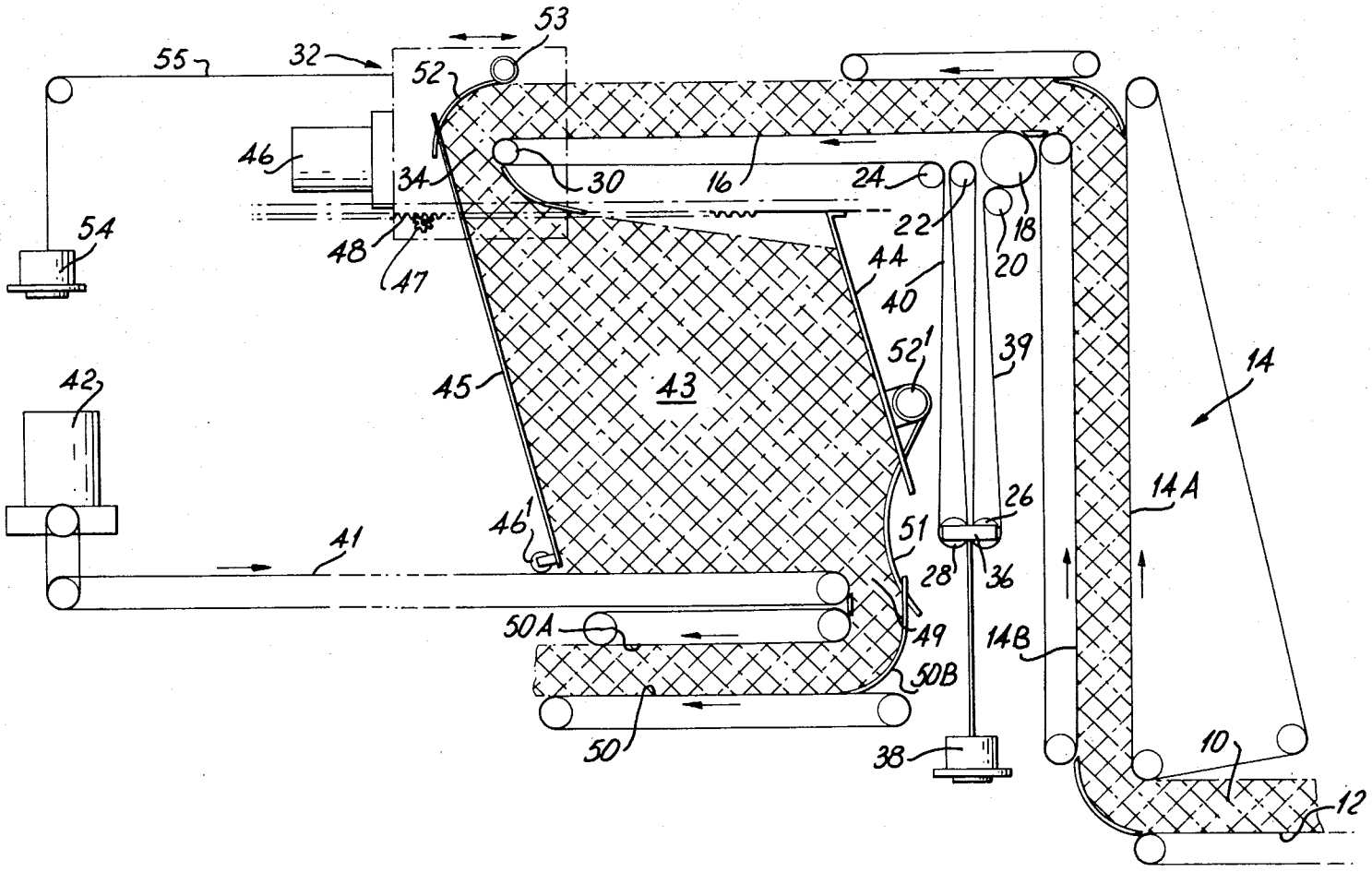
12
10
14
14A
14B
18
20
39
26
36
22
40
52'
28
51
49
50B
38
24
44
16
43
30
50
53
50A
46'
52
34
45
47
48
41
32
46
55
54
42

RESERVOIR FOR CIGARETTES AND LIKE ARTICLES

This invention is concerned mainly with an improvement in the form of reservoir described with reference to FIG. 5 of U.S. patent application, Ser. No. 786,502, filed Apr. 11, 1977. That application is concerned mainly with conveying double unit filter cigarettes prior to their final cutting (into individual cigarettes) at the cigarette packing machine. However, substantially the same reservoir may in principle be used for cigarette filter rods or for individual cigarettes.

According to the present invention a reservoir system for cigarettes and other similar rod-shaped articles comprises a delivery conveyor arranged to convey the articles horizontally towards an inlet to the reservoir; a reservoir conveyor which lies below the delivery conveyor and is arranged to receive a stack of the articles delivered through the inlet and to run, when necessary, in a direction opposite to that of the delivery conveyor; a horizontally movable carriage carrying a movable end wall defining an end of the stack of articles on the reservoir conveyor adjacent to the inlet, and carrying also a sensor adjacent to the inlet which controls the direction (and possibly also the speed) of movement of the carriage; and an outlet for articles at the end of the reservoir conveyor towards which the latter moves.

This invention eliminates a potential problem which exists with the arrangement shown in FIG. 5 of the above-mentioned patent application. The problem is as follows: when the overhead conveyor 63 stops delivering cigarettes (for example) to the reservoir 60 (because the cigarette-making machine has stopped), while the packing machine 83 continues to drain cigarettes from the left-hand of the reservoir, the carriage 76 moves to the left to deliver cigarettes from the reservoir, and therefore creates a void at the left-hand end of the conveyor 63. The creation of such a void can produce problems in that (unless suitable precautions are taken) the cigarettes can roll and become askew.

The present invention avoids the creation of any void since the reservoir moves in the opposite direction to the delivery conveyor. When cigarettes cease to be delivered into the reservoir by the delivery conveyor, while cigarettes continue to be drained from the reservoir through the outlet, the movable carriage moves in the same direction as the reservoir conveyor and therefore, instead of creating a void, it in fact results in articles on the delivery conveyor being absorbed into the reservoir.

An example of a reservoir system according to this invention is shown diagrammatically in the accompanying drawing.

For convenience, the articles being handled will be referred to as "cigarettes" in the following description.

As shown in the drawing a stack of cigarettes 10 is carried by a conveyor 12 to the lower end of an elevator 14 by which the stack is carried upwards to an overhead delivery conveyor 16. The elevator 14 comprises conveyor bands 14A and 14B and may be basically as described in our British patent specification No. 1,435,191 or as described in U.S. patent application Ser. No. 859,708, filed Dec. 12, 1977.

The delivery conveyor 16 passes around pullyes 18, 20, 22 and 24 which are mounted on fixed axes, around a pair of vertically movable pulleys 26, 28, and around a pulley 30 which is carried by a horizontally movable carriage 32. Movement of the carriage 32 varies the horizontal position of a reservoir inlet 34; and such movement is accompanied by upward or downward movement of the pulleys 26 and 28, which are coupled together by a bracket 36 carrying a weight 38 and lie at the bottom of downwardly extending loops 39 and 40 in the return section of the conveyor 16.

Below the delivery conveyor 16 there is a reservoir conveyor 41 which is driven (when necessary) by a motor 42 in a direction opposite to that of the delivery conveyor 16. A stack of cigarettes 43 is formed on the conveyor 41, and the ends of the stack are defined respectively by a fixed wall 44 and a movable wall 45 carried by the carriage 32.

The movable wall 45 is thin and relatively flexible and is rigidly connected at its upper end to the carriage 32. At its lower end it carries a roller 46' which runs along the reservoir conveyor 41 and prevents the lower edge of the wall 45 from engaging the conveyor band 41 under the pressure of the cigarettes.

The carriage 32 may be supported on horizontal tracks (not shown) in any known manner. It is arranged to be driven horizontally by the motor 46 driving a pinion 47 (via an appropriate reduction gear) engaging a horizontal rack 48.

Cigarettes are delivered from the reservoir through an outlet 49 at the downstream end of the reservoir conveyor 41, being carried from the outlet 49 by a further conveyor 50 with the aid of a top band 50A driven in unison with the conveyor 50.

A sensor 51 is pivotally mounted by a spindle 52' near the lower end of the fixed end wall 44 and responds to the pressure of the cigarettes in that area, being lightly urged towards the cigarettes, e.g. by means of a light spring (not shown). Movement of the sensor 51 is transmitted via the spindle 52' to a rotary regulator (of known construction) which controls the speed at which the motor 42 drives the reservoir conveyor 41. The sensor 51 may also be arranged to switch off the motor 42 when it detects (on reaching a limiting outer position) that no cigarettes are being delivered from the reservoir by the conveyor 50.

The sensor 51 passes through a slot in the lower end of the wall 44 and in the upper end of a fixed guide 50B.

A further sensor 52 is mounted on the carriage 32, being pivoted on a spindle 53. This sensor detects the pressure or volume of cigarettes in the region of the reservoir inlet 34 and controls the direction of movement and preferably also the speed of movement of the carriage 32. The arrangement is such that the depth of the stack 43 on the reservoir conveyor is maintained substantially constant.

When the rate of delivery of cigarettes into the reservoir through the inlet 34 exceeds the rate of delivery from the reservoir through the outlet 49, cigarettes pile up under the sensor 52 and the resulting upward swinging of the sensor 52 away from the inlet 34 causes the motor 46 to drive the carriage 32 to the left, thus accumulating more cigarettes in the reservoir. Conversely, when the output from the reservoir exceeds the input to the reservoir (which may become zero when the cigarette-making machine or other supply equipment stops), this is detected by the sensor 52, which swings downwards towards the inlet 34 and causes the motor 46 to drive the carriage 32 to the right. During the last-mentioned mode of operation, the pulley 30 for the delivery conveyor 16 also moves to the left, and the resulting shortening of the stack of cigarettes on the conveyor 16

(measured horizontally from the upper end of the elevator 14) is accommodated by the fact that the cigarettes at the left-hand end of the conveyor 16 pass downwards through the reservoir inlet and are absorbed into the reservoir. Consequently, in order to accommodate the resulting increase in the cigarettes at the left-hand end of the reservoir, it will be understood that the carriage 32 is arranged to move at a speed slightly lower than that of the reservoir conveyor 41 (assuming that the speed of the carriage 32 is continuously regulated by the sensor 52 in the preferred manner).

The edges of the conveyor band 16 are supported by rows of flexible devices which move apart to allow the pulley 30 to pass. The arrangement is basically as described with reference to FIGS. 7 to 9 of our British patent specification No. 995,663.

A counter-weight 54 is connected to the carriage 32 by a chain 55 so as to tend to pull the carriage 32 to the left. The force of the counterweight 54 balances that of the weighted pulleys 26, 28 which tends to pull the carriage 32 to the right. This relieves the motor 46 of unnecessary load.

We claim:

1. A reservoir system for cigarettes and other similar rod-shaped articles comprising a delivery conveyor arranged to convey the articles horizontally towards an inlet to the reservoir; a reservoir conveyor which lies below the delivery conveyor and is arranged to receive a stack of the articles delivered through the inlet and to run, when necessary, in a direction opposite to that of the delivery conveyor; a horizontally movable carriage carrying a movable end wall defining an end of the stack of articles on the reservoir conveyor adjacent to the inlet, and carrying also a sensor adjacent to the inlet which controls the direction of movement of the carriage; and an outlet for articles at the end of the reservoir conveyor towards which the latter moves.

2. A reservoir system according to claim 1, in which the sensor is also arranged to control the speed of movement of the carriage.

3. A reservoir system according to claim 1 or claim 2 including a second sensor which is adjacent to the outlet, responds to the pressure of cigarettes at the outlet and is arranged to control the speed at which the reservoir conveyor is driven towards the outlet.

4. A reservoir system according to claim 1 in which the outlet is at or in the vicinity of the lower end of a fixed wall defining an end of the stack of articles on the reservoir conveyor.

5. A reservoir system according to claim 4 in which the second sensor comprises a plate pivoted to the fixed wall and arranged to bear on the articles in an area between the outlet and the lower end of the fixed wall.

6. A reservoir system according to claim 1 in which the delivery conveyor passes around a pulley on the movable carriage and around at least one vertically movable pulley lying in a loop of varying length to accommodate movement of the pulley on the movable carriage.

7. A reservoir system according to claim 1 in which the first-mentioned sensor is arranged to control movement of the movable carriage so as to maintain a stack of articles of substantially constant depth on the reservoir conveyor.

8. A reservoir system according to claim 7, including means for moving the movable carriage so that movement of the carriage towards the outlet occurs at a speed which is slightly less than the speed of the reservoir conveyor to allow articles on the delivery conveyor at the end adjacent to the inlet to be absorbed into the reservoir.

* * * * *